US007395682B2

(12) United States Patent
Park

(10) Patent No.: US 7,395,682 B2
(45) Date of Patent: Jul. 8, 2008

(54) BUTTON ASSEMBLY AND WASHING MACHINE HAVING THE SAME

(75) Inventor: Hye Yong Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 466 days.

(21) Appl. No.: 10/926,022

(22) Filed: Aug. 26, 2004

(65) Prior Publication Data

US 2005/0138972 A1 Jun. 30, 2005

(30) Foreign Application Priority Data

Dec. 26, 2003 (KR) ..... 10-2003-0097786

(51) Int. Cl.
*D06F 33/00* (2006.01)

(52) U.S. Cl. ..... 68/3 R; 68/12.01

(58) Field of Classification Search ..... 68/3 R, 68/12.27; 200/5 E

See application file for complete search history.

(56) References Cited

U.S. PATENT DOCUMENTS

| | | | | | |
|---|---|---|---|---|---|
| 2,265,124 | A | * | 12/1941 | Andres | 194/244 |
| 2,391,718 | A | * | 12/1945 | Lindemann | 307/141.4 |
| 2,713,092 | A | * | 7/1955 | Rucks et al. | 200/5 E |
| 2,819,356 | A | * | 1/1958 | Hutt | 200/5 E |
| 2,819,540 | A | * | 1/1958 | Toma et al. | 34/547 |
| 2,888,986 | A | * | 6/1959 | Naxon | 73/3.5 |
| 2,921,159 | A | * | 1/1960 | Elderton et al. | 200/83 P |
| 2,934,926 | A | * | 5/1960 | Buechler | 68/12.23 |
| 3,015,003 | A | * | 12/1961 | Simmons | 200/38 B |
| 3,065,618 | A | * | 11/1962 | Cobb et al. | 62/12.19 |
| 3,137,773 | A | * | 6/1964 | Black | 200/5 E |
| 3,226,493 | A | * | 12/1965 | Reimer | 200/5 E |
| 3,402,620 | A | * | 9/1968 | Mukai et al. | 74/483 R |
| 3,646,283 | A | * | 2/1972 | Hansen | 200/5 EB |
| 3,659,061 | A | * | 4/1972 | Andreaggi | 200/5 EA |
| 3,749,870 | A | * | 7/1973 | Oakes | 200/302.1 |
| 4,074,089 | A | * | 2/1978 | Mitsugi et al. | 200/5 E |
| 4,297,541 | A | * | 10/1981 | Niinuma | 200/5 E |
| 4,540,865 | A | * | 9/1985 | Calder | 200/512 |
| 4,617,432 | A | * | 10/1986 | Hanssen et al. | 200/81 R |
| 5,045,647 | A | * | 9/1991 | Kato | 200/5 E |
| 5,083,883 | A | * | 1/1992 | Ueda et al. | 403/328 |
| 5,932,854 | A | * | 8/1999 | Umemura | 200/5 B |
| 2001/0003539 | A1 | * | 6/2001 | Hahm et al. | 379/368 |

FOREIGN PATENT DOCUMENTS

| | | | |
|---|---|---|---|
| DE | 34 18 227 | * | 11/1985 |
| DE | 36 21 260 | * | 1/1988 |
| DE | 44-33-983 | * | 3/1996 |
| JP | 1-236095 | * | 9/1989 |
| JP | 2-165525 | * | 6/1990 |
| JP | 7-47498 | * | 2/1995 |

OTHER PUBLICATIONS

Europena Patent Office 0 615 884 Sep. 1994.*

* cited by examiner

*Primary Examiner*—Frankie L. Stinson
(74) *Attorney, Agent, or Firm*—McKenna Long & Aldridge LLP

(57) ABSTRACT

A button assembly and washing machine having the same, in which the adjacent push buttons are prevented from being pressed together by a user. The button assembly includes a panel, at least two push buttons provided to the panel, and at least one push guide provided on a surface of the panel for preventing the at least two push buttons from being simultaneously pressed together by a user.

21 Claims, 5 Drawing Sheets

BUTTON ASSEMBLY AND WASHING MACHINE HAVING THE SAME

This application claims the benefit of Korean Application No. P2003-097786, filed on Dec. 26, 2003, which is hereby incorporated by reference.

BACKGROUND OF THE INVENTION

1. Field of the Invention

The present invention relates to a washing machine, and more particularly, to a button assembly and washing machine having the same, in which adjacent push buttons are prevented from being incorrectly pressed.

2. Discussion of the Related Art

Generally, in a washing machine, a tub contains water and detergent inside and a laundry is put in a drum installed within the tub. And, the drum is rotated to perform washing, rinsing, and dewatering. The washing machine is an apparatus for removing filth or dirt attached to the laundry using the detergent and mechanical energy applied thereto appropriately. Specifically, a drum, which is horizontally installed within a drum type washing machine, contains detergent, water, and laundry therein and is then rotated by a drive force of a motor to remove filth or dirt attached the laundry. Such a drum type washing machine avoids causing damage or ravel to the laundry, consumes less water, and brings about a washing effect of beating and rubbing.

FIG. 1 shows a perspective view of a washing machine according to a related art. Referring to FIG. 1, a washing machine according to a related art consists of a cabinet 10 forming an overall exterior, an opening 11 formed at a front side of the cabinet 10 for putting/pulling a laundry in/from the washing machine, a door 12 provided to the front side of the cabinet 10 to open/close the opening 11, a tub (not shown) provided within the cabinet 10 to contain water therein, a drum 20 rotatably installed within the cabinet 10 to perform washing on the laundry therein, a multitude of perforated holes formed at a wall of the drum 20 so that the water passes through the perforated holes, a control panel 30 provided to an upper front side of the cabinet 10 to control an operational state of the washing machine, and a detergent input unit 40 for inputting a detergent or additive. Moreover, a button assembly 31 for inputting an operational condition (or operational commands) of the washing machine and a display unit for displaying an operational state of the washing machine are provided to the control panel 30.

The button assembly is explained in detail by referring to FIGS. 1 and 2 as follows. First of all, the button assembly 31 consists of a plurality of push buttons 31*a* operated by user's push action for an operational condition input of a washing machine and a panel unit 31*b* on which the push buttons 31*a* are provided. Moreover, a power switch 31*c* for power input and a rotary switch 31*d* for inputting an operational condition of the washing machine by rotation are provided near the push buttons 31*a*.

The push buttons 31*a* protrude higher than the panel unit 31*b*. Once a user presses a specific one of the push buttons 31*a*, the pressed push button is moved downward to actuate a predetermined switching means. Once the pressing force from the user is released, the corresponding push button is moved upward to return to its original position.

However, in the related art button assembly, when a user presses a specific push button for the operational condition input of the washing machine, another push button in the vicinity of the specific push button is simultaneously pressed, whereby an unwanted operation condition is inputted to bring about a wrong operation of the washing machine. Hence, the user should be cautious to press the specific push button. Moreover, if the push buttons decrease in size in case of a small-sized washing machine, if an interval between the push buttons is narrow, or if a user has a big hand, the above problem becomes more serious.

SUMMARY OF THE INVENTION

Accordingly, the present invention is directed to a button assembly and washing machine having the same that substantially obviate one or more of the problems due to limitations and disadvantages of the related art.

An object of the present invention, which has been devised to solve the foregoing problem, lies in providing a button assembly and washing machine having the same, by which a wrong button is prevented from being pressed for a washing machine operation by a user to prevent a false operation of the washing machine.

Another object of the present invention, which has been devised to solve the foregoing problem, lies in providing a button assembly and washing machine having the same, by which a false operation of the washing machine is prevented regardless of a washing machine size, a hand size of a user operating the washing machine, and the like.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, a button assembly includes a panel, at least two push buttons provided to the panel, arid at least one push guide provided on a surface of the panel for preventing the at least two buttons from being simultaneously pressed together by a user.

The push guide includes an isolation wall protruding from the surface of the panel higher than the at least two push buttons to isolate the at least two push buttons from each other. The isolation wall is provided between the at least two push buttons, and a top surface of the isolation wall is convexly curved. And, the isolation wall is rigidly fixed to the panel.

Meanwhile, the push guide may include at least two isolation walls protruding from the surface of the panel higher than the at least two push buttons along circumferences of the at least two push buttons, respectively, to isolate the at least two push buttons. In this case, the at least two isolation walls are rigidly fixed to the panel. And, the push guide may be formed as a single body.

In another aspect of the present invention, a washing machine includes a cabinet forming an exterior of the washing machine, a tub provided within the cabinet to contain water therein, a drum rotatably provided within the tub to perform laundry washing therein, and a button assembly provided to one side of the cabinet to input operational commands of the washing machine, wherein the button assembly includes a panel, at least two push buttons provided to the panel, and at least one push guide provided on a surface of the panel for preventing the at least two buttons from being simultaneously pressed together by a user.

The push guide includes an isolation wall protruding from the panel surface higher than the at least two push buttons to isolate the at least two push buttons from each other. The isolation wall is provided between the at least two push buttons, and a top surface of the isolation wall is convexly curved. In this case, the isolation wall is rigidly fixed to the panel.

Meanwhile, the push guide may include at least two isolation walls protruding from the panel surface higher than the at least two push buttons along circumferences of the at least two push buttons, respectively, to isolate the at least two push buttons. In this case, the at least two isolation walls are rigidly fixed to the panel. And, the push guide may be formed as a single body. And, the button assembly is provided to a front side of the cabinet or a topside of the cabinet.

Moreover, each of the at least two push buttons returns to its original position if a pressing force applied thereto is released. Furthermore, the washing machine further includes a display unit provided to one side of the button assembly to display an operational state of the washing machine.

By the above-constituted washing machine, it is able to prevent the adjacent push buttons from being simultaneously pressed together by a user, the push buttons being pressed by the user for an operation of the washing machine.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings. Throughout the drawings, like elements are indicated using the same or similar reference designations where possible.

Figure 1:
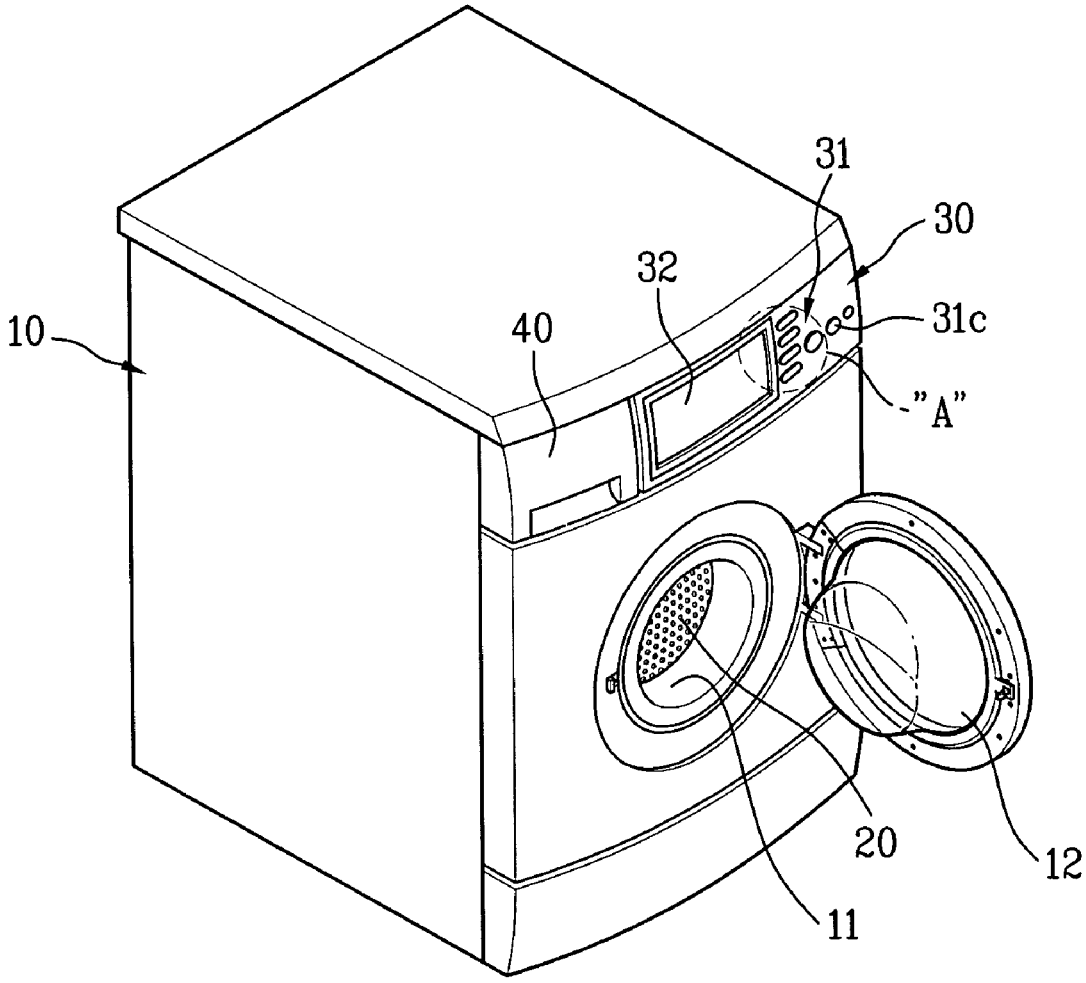
FIG. 1 is a perspective diagram of a washing machine according to a related art.
Figure 2:
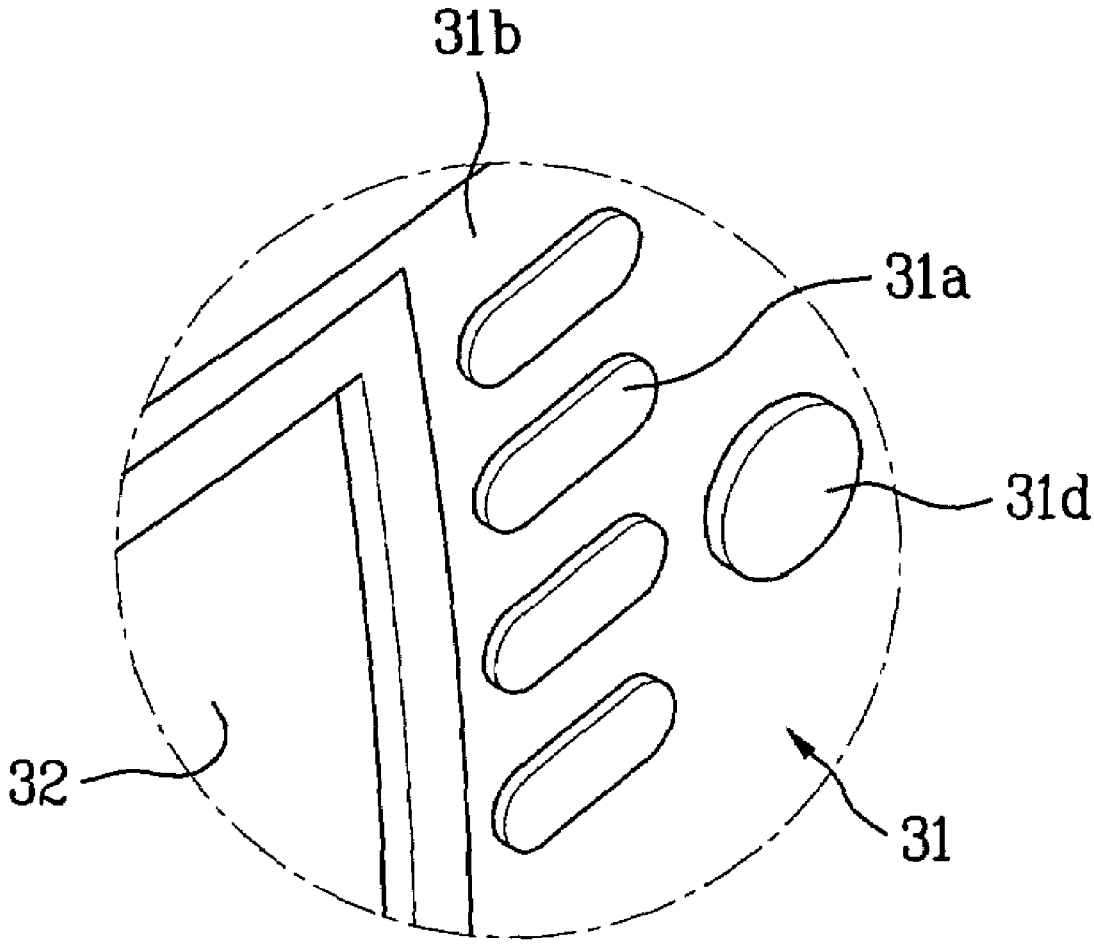
FIG. 2 is a magnified perspective diagram of a part 'A' in FIG. 1.
Figure 3:
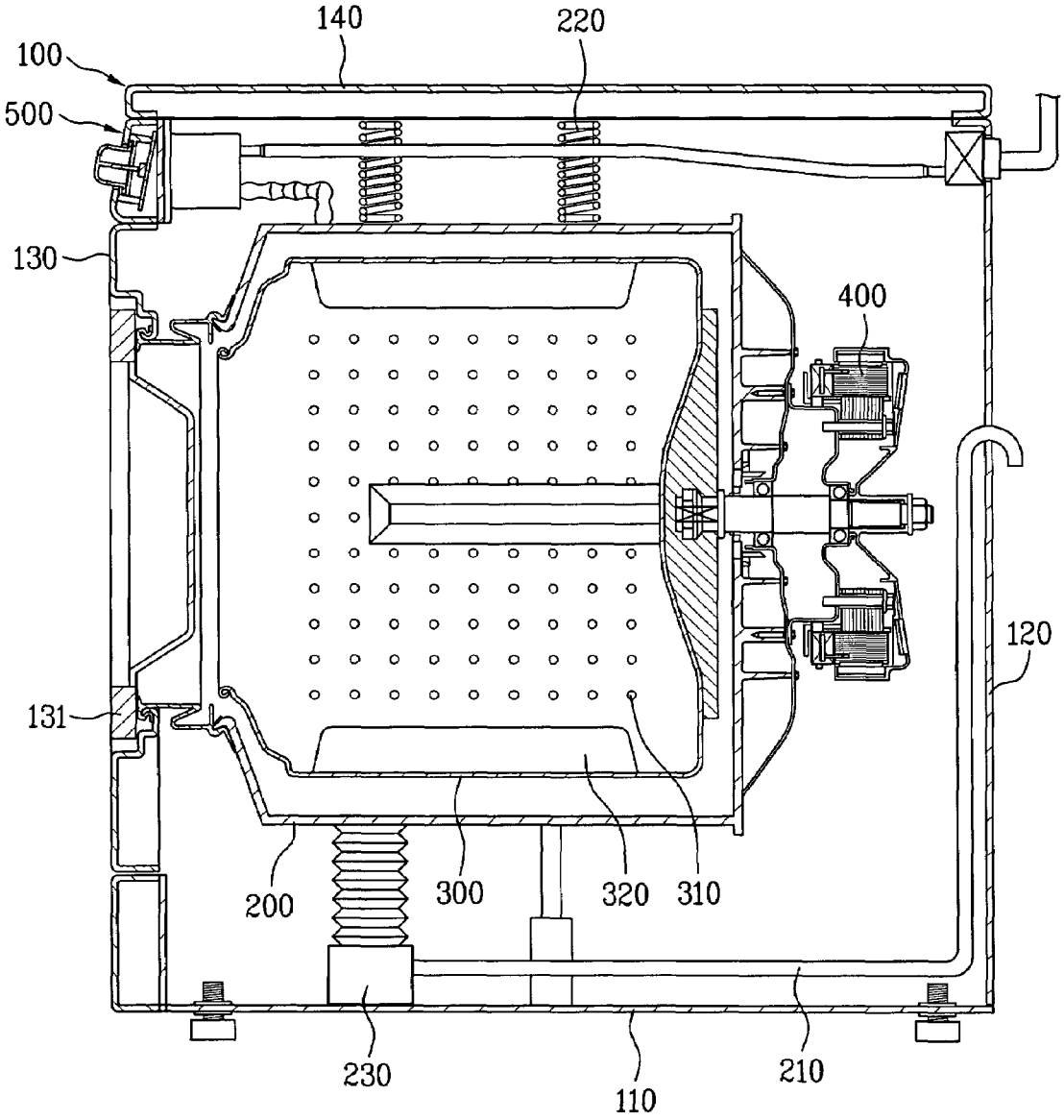
FIG. 3 is a cross-sectional diagram of washing machine having a button assembly according to the present invention.
Figure 4:
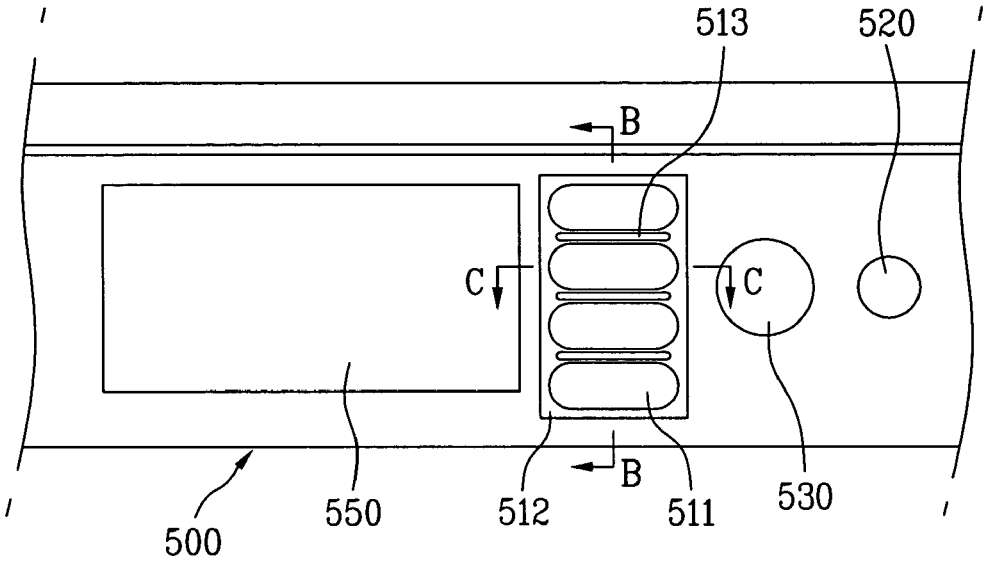
FIG. 4 is a layout of a button assembly provided to a washing machine according to the present invention.
Figure 5:
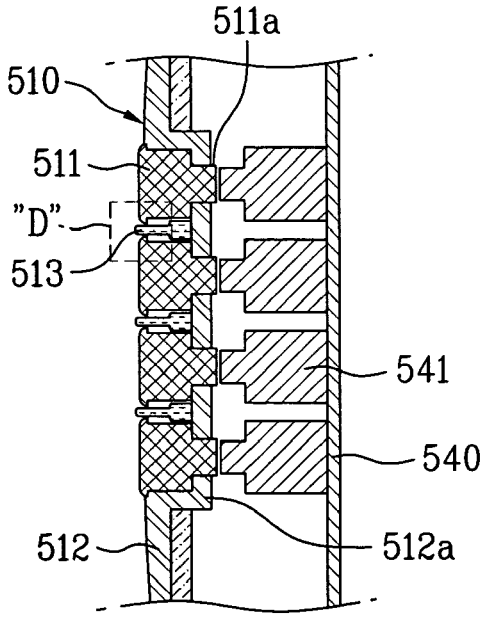
FIG. 5 is a cross-sectional diagram of a button assembly taken along line B-B of FIG. 4.
Figure 6:
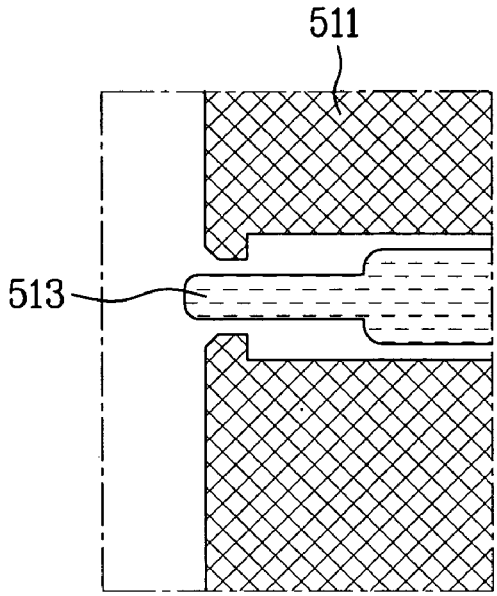
FIG. 6 is a magnified perspective diagram of a part 'D' in FIG. 5.
Figure 7:
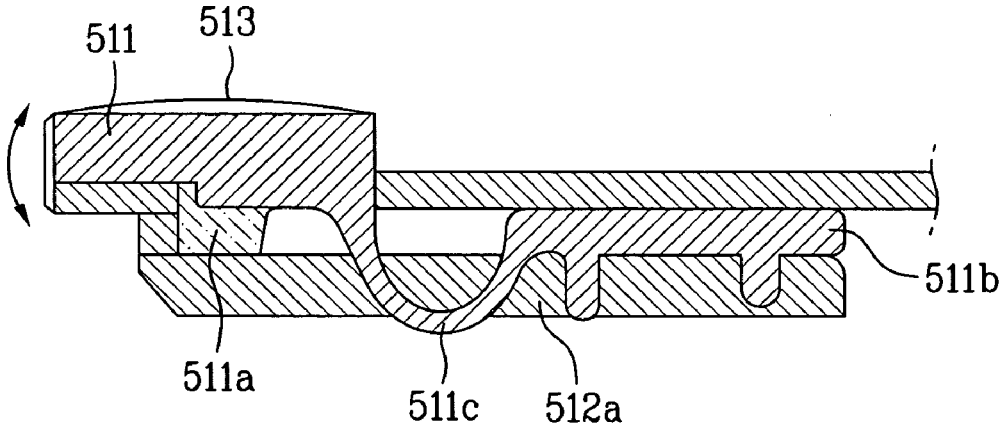
FIG. 7 is a cross-sectional diagram of a button assembly taken along line C-C of FIG. 4.

FIG. 3 is a cross-sectional diagram of washing machine having a button assembly according to the present invention. FIG. 4 is a layout of a button assembly provided to a washing machine according to the present invention. FIG. 5 is a cross-sectional diagram of a button assembly taken along line B-B of FIG. 4. FIG. 6 is a magnified perspective diagram of a part 'D' in FIG. 5. And, FIG. 7 is a cross-sectional diagram of a button assembly taken along line C-C of FIG. 4.

Referring to FIGS. 3 and 4, a drum type washing according to one embodiment of the present invention includes a cabinet 100 forming an exterior, a tub 200 provided within the cabinet 100, a drum 300 rotatably provided within the tub 200, and a rotating means 400 for rotating the drum 300. The cabinet 100 includes a base plate 110 provided to a bottom side, a pair of side plates (not shown) provided to both sides of the base plate 110, a rear plate 120 provided to rear sides of the base plate 110 and side plates, a front plate 130 provided to front sides of the base plate 110 and side plates, and a top plate 140 provided to topsides of the rear plate 120, side plates, and front plate 130.

An opening (not shown) is formed at a center of the front plate 130 so that a laundry is put/pulled in/out via the opening. And, a door 131 for preventing the laundry from being separated from the opening is provided to open/close the opening. Moreover, a control panel 500 for controlling an operation of the drum type washing machine is installed on an upper part of the front plate 130. The tub 200 is supported by an elastic means 220 such as a spring and a damper (not shown) to attenuate vibration generated from operation of the drum type washing machine. And, an entrance (not shown) is formed at a front end of the tub 200 to confront the opening of the cabinet 100.

The drum 300 has a cylindrical shape, and a multitude of perforated holes 310 are formed thereon to let water pass through. At least one lifter 320 is provided to an inner wall of the drum 300 to lift a laundry up to a predetermined height. Once the drum 300 is rotated, the laundry contained within the drum 300 is repeatedly lifted upward to fall by gravity to perform washing.

A circular entrance (not shown) confronting the entrance of the tub 200 is formed at a front end of the drum 300. Hence, the circular entrance of the drum 300, the entrance of the tub 200, and the opening of the cabinet 100 construct a laundry entrance/exit part via which the laundry goes in or comes out of the drum 300.

The rotating means 400 can include an induction motor or BLDC motor provided in rear of the tub 200. A rotational shaft of the motor is connected to a rear end center of the drum 300 to perform forward or reverse rotation of the drum 300. Also, a drain pump 230 and drain hose 240 for drain of water are installed under the tub 200. Meanwhile, a button assembly 510 for inputting an operational condition of the washing machine and a display unit 550 displaying an operational state of the washing machine are provided to the control panel 500.

A button assembly according to the present invention is explained in detail by referring to FIGS. 4 to 7 as follows.

First of all, the button assembly 510 includes a plurality of push buttons 511 operated by user's push behavior for an operational condition input to the washing machine, a panel unit 512 having the push buttons 511 provided thereto, and at least one push guide part preventing one of the push buttons 511 from being simultaneously pressed together with another push button(s). And, a power switch 520 turning on/off power of the washing machine and a rotary switch 530 rotated to perform an operation of inputting an operational condition of the washing machine may be further provided in the vicinity of the push buttons 511.

In this case, each of the push buttons 511 is loaded on a button hole formed in the panel unit 512 to be moved by the user's push behavior in a direction opposite to a pressed direction of the corresponding push button 511. And, the push guide part includes a isolation wall 513 protruding higher than the push buttons 511 to isolate the push buttons 511 from each other. Unlike the push buttons 511, the isolation wall 513 is fixed to the panel unit 512. When a user presses a specific one of the push buttons 511, the isolation wall 513 prevents another button(s) from being pressed by a user's finger.

Referring to FIGS. 5 and 6, a circuit board 540, to which a plurality of wires and electric elements provided are provided to control an operation of the washing machine, and a plurality of switches 541, which are provided on to the circuit board 540 to input electric signals to the circuit board 540 by the push buttons 511, respectively, are provided within the control panel 500 including the button assembly 510 according to the present invention.

The panel unit 512 having the push buttons 511 loaded thereon is placed in front of the switches 541 and the circuit board 540, and a button support part 512*a* supporting the push buttons 511 is provided to the panel unit 512. In the rear of each of the push buttons 511, a push part 511*a* is provided to directly press the corresponding switch 541 when a user presses a front end of the corresponding push button 511. The isolation wall, which is fixed to the button support part 512*a* provided to the panel unit 512 not to be moved, is provided to a boundary between the push buttons 511. Preferably, the isolation wall 513 protrudes from the boundary between the push buttons 511 to be higher than the push buttons 511.

When a user presses a specific one of the push buttons 511, a user's finger pressing the specific push button is caught on the isolation wall 513 and is guided to press the specific push button only. Hence, other neighbor push buttons enable to avoid being pressed.

Referring to FIG. 7, an upper surface of the isolation wall 513 has a convexly curved shape to protrude higher than the push buttons 511, thereby enabling the neighbor push buttons to concretely avoid being pressed when a user presses a specific one of the push buttons 511. A button connecting part 511*b* extends from a rear end of the push button 511 in one direction to prevent the corresponding push button 511 from being separated from the panel unit 512.

Specifically, the button connecting part 511*b* is fixed to the button support part 512*a* of the panel unit 512. Preferably, an elastic part 511*c* convexly bent in a rear direction is formed in the middle of the button connecting part 511*b*. The elastic part 511*c* is elastically transformed to enable the push part 511*a* to press the corresponding switch when a user presses the corresponding push button 511. If the user's pressing force is released, the elastic part 511*c* enables the corresponding push button 511 to return to its original position. Namely, the elastic part 511*c* elastically supports the corresponding push button 511 and enables the corresponding push button to return to its original position in case of releasing the user's pressing force.

In the embodiment of the present invention, the button connecting part 511*b* of the push button 511 and the isolation wall 513 are fixed to the button support part 512*a* of the panel unit 512. Yet, the present invention intends not to put limitation on such a structure. Namely, the button connecting part 511*b* and the isolation wall 513 can be coupled to another element having a fixed position, another part of the panel unit 512 except the button support part 512*a*, the circuit board 540, or the like. Meanwhile, the push guide part is provided to protrude higher than the push button 511 along a circumference of the push button 511 and may include the isolation wall (now shown) isolating the push buttons from each other. In this case, the isolation wall is fixed to the panel unit 512. And, the push guide part may be built in one body (or formed as a single body).

The above-constructed button assembly can be provided to the topside of the cabinet as well as the front side of the cabinet 100. Namely, the control panel 500 can be provided to an upper surface of the top plate 140.

Accordingly, the present invention provides the following advantages or effects.

First of all, a specific push button pressed by a user for a washing machine operation is prevented from being simultaneously pressed together with another push button(s). Therefore, the present invention prevents a false operation of the washing machine, thereby brings convenience of using the washing machine.

Secondly, a false operation of the washing machine is prevented regardless of a washing capacity, a push button size, a hand size of a user operating the washing machine, and the like.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A button assembly, comprising:

a panel;

at least two push buttons provided to the panel, wherein each push button comprises a button connecting part extending from a rear end of the push button, the button connecting part extending from the push button in a direction substantially perpendicular to a functional direction of the push button, and having:

a convexly bent elastic portion adjacent to the rear end of the push button, and an anchoring portion, adjacent to the elastic portion, wherein the anchoring portion anchors the push button to the panel; and at least one push guide provided on a surface of the panel for preventing the at least two push buttons from being simultaneously pressed together by a user.

2. The button assembly of claim 1, wherein the push guide comprises an isolation wall protruding from the surface of the panel higher than the at least two push buttons to isolate the at least two push buttons from each other.

3. The button assembly of claim 2, wherein the isolation wall is provided between the at least two push buttons, and wherein a top surface of the isolation wall is convexly curved.

4. The button assembly of claim 2, wherein the isolation wall is rigidly fixed to the panel.

5. The button assembly of claim 1, wherein the push guide comprises at least two isolation walls protruding from the surface of the panel higher than the at least two push buttons along circumferences of the at least two push buttons, respectively, to isolate the at least two push buttons from each other.

6. The button assembly of claim 5, wherein the at least two isolation walls are rigidly fixed to the panel.

7. The button assembly of claim 5, wherein the push guide is formed as a single body.

8. The button assembly of claim 1, wherein the button connecting part extends laterally from the push button in only one direction.

9. The button assembly of claim 1, wherein each push button further comprises a retaining surface oriented perpendicular to the anchoring part and projecting from a backside of the push button.

10. A washing machine, comprising:

a cabinet forming an exterior of the washing machine;

a tub provided within the cabinet to contain water therein;

a drum rotatably provided within the tub to perform laundry washing therein; and a button assembly provided to one side of the cabinet to input operational commands of the washing machine, wherein the button assembly comprises:

a panel;

at least two push buttons provided to the panel, wherein each push button comprises a button connecting part extending from a rear end of the push button, the button connecting part extending from the push button in a direction substantially perpendicular to a functional direction of the push button, and having:

a convexly bent elastic portion adjacent to the rear end of the push button, and an anchoring portion, adjacent to the elastic portion, wherein the anchoring portion anchors the push button to the panel; and at least one push guide provided on a surface of the panel for preventing the at least two push buttons from being simultaneously pressed together by a user.

11. The washing machine of claim 10, wherein the push guide comprises an isolation wall protruding from the surface of the panel higher than the at least two push buttons to isolate the at least two push buttons from each other.

12. The washing machine of claim 11, wherein the isolation wall is provided between the at least two push buttons, and wherein a top surface of the isolation wall is convexly curved.

13. The washing machine of claim 11, wherein the isolation wall is rigidly fixed to the panel.

14. The washing machine of claim 10, wherein the push guide comprises at least two isolation walls protruding from the surface of the panel higher than the at least two push buttons along circumferences of the at least two push buttons, respectively, to isolate the at least two push buttons from each other.

15. The washing machine of claim 14, wherein the at least two isolation walls are fixed to the panel.

16. The washing machine of claim 14, wherein the push guide is formed as a single body.

17. The washing machine of claim 10, wherein the button assembly is provided to a front side of the cabinet.

18. The washing machine of claim 10, wherein the button assembly is provided to a topside of the cabinet.

19. The washing machine of claim 10, wherein each of the at least two push buttons returns to its original position if a pressing force applied thereto is released.

20. The washing machine of claim 10, further comprising a display unit provided to one side of the button assembly to display an operational state of the washing machine.

21. The button assembly of claim 10, wherein each push button further comprises a retaining surface oriented perpendicular to the anchoring part and projecting from a backside of the push button.

* * * * *